US010096899B2

(12) United States Patent
Renard et al.

(10) Patent No.: US 10,096,899 B2
(45) Date of Patent: Oct. 9, 2018

(54) METHOD FOR ORIENTING THE BEAM OF AN ELECTRONIC SCANNING ANTENNA, AND SENDING/RECEIVING SYSTEM IMPLEMENTING SUCH A METHOD

(71) Applicant: THALES, Courbevoie (FR)

(72) Inventors: Christian Michel Renard, Elancourt (FR); Jaki Amar, Elancourt (FR); Philippe Freyssinier, Elancourt (FR)

(73) Assignee: THALES, Courbevoie (FR)

( * ) Notice: Subject to any disclaimer, the term of this patent is extended or adjusted under 35 U.S.C. 154(b) by 143 days.

(21) Appl. No.: 15/028,016

(22) PCT Filed: Nov. 18, 2014

(86) PCT No.: PCT/EP2014/074822
§ 371 (c)(1),
(2) Date: Apr. 7, 2016

(87) PCT Pub. No.: WO2015/078721
PCT Pub. Date: Jun. 4, 2015

(65) Prior Publication Data

US 2016/0268680 A1 Sep. 15, 2016

(30) Foreign Application Priority Data

Nov. 29, 2013 (FR) ..... 13 02778

(51) Int. Cl.
*H01Q 3/00* (2006.01)
*H01Q 3/26* (2006.01)

(52) U.S. Cl.
CPC ..... *H01Q 3/267* (2013.01)

(58) Field of Classification Search
CPC ..... G01S 1/08; H01Q 3/22
USPC ..... 342/81, 154, 359, 369, 371, 376
See application file for complete search history.

(56) References Cited

U.S. PATENT DOCUMENTS 5,680,141 A 10/1997 Didomenico et al.
6,320,538 B1 11/2001 Lalezari et al.
2010/0033375 A1 2/2010 Mason et al.

FOREIGN PATENT DOCUMENTS

FR 2 949 610 A1 3/2011

*Primary Examiner* — Dao L Phan
(74) *Attorney, Agent, or Firm* — Baker & Hostetler LLP

(57) ABSTRACT

An electronic scanning antenna composed of an array of radiating elements positioned in an initial geometric configuration at a reference temperature, geometric configuration models of the array as a function of the temperature having been set up beforehand, the orientation of the beam being carried out by: a first phase of measuring the temperature of the array in order to select a model corresponding to the measured temperature; a second phase of calculating the phases to be applied to the signals of the radiating elements, the phases to be applied depending on the selected model.

10 Claims, 2 Drawing Sheets

METHOD FOR ORIENTING THE BEAM OF AN ELECTRONIC SCANNING ANTENNA, AND SENDING/RECEIVING SYSTEM IMPLEMENTING SUCH A METHOD

CROSS-REFERENCE TO RELATED APPLICATIONS

This application is a National Stage of International patent application PCT/EP2014/074822, filed on Nov. 18, 2014, which claims priority to foreign French patent application No. FR 1302778, filed on Nov. 29, 2013, the disclosures of which are incorporated by reference in their entirety.

FIELD OF THE INVENTION

The present invention relates to a method for orienting the beam radiated by an electronic scanning antenna. It also relates to an electromagnetic sending and receiving system implementing such a method. In particular, it is applicable to any type of electronic scanning antenna, used, for example, in radars, telecommunication systems or multifunctional arrays.

BACKGROUND

Electronic scanning antennas are formed from modules positioned in an array. Each module comprises at least one radiating element contributing to the formation of the sending and/or receiving beam. It is known that the direction of the radiated beam is determined by the phase applied to the signal sent or received at each radiating element. Stated otherwise, the direction of the radiated beam is controlled by the phases applied to the radiating elements according to a known law. The modules may or may not be active, the active modules moreover integrating an amplifier of the sent signal.

Thus, an electronic scanning antenna has, for a radar for example, a microwave-frequency architecture consisting of channels comprising, in particular, amplifier modules that may be used for sending and for receiving, which are associated with multifunctional circuits comprising phase-shift elements for aiming the beam in directions other than the normal to the array, each module being equipped with a radiating element.

A drawback of electronic scanning antennas is that they are subject to a misalignment of the radiated beam depending on the temperature. A misalignment such as this is not acceptable with the angular precisions demanded for most radar applications in particular. This misalignment is due to the mechanical deformation of the antenna. More particularly, when the temperature increases, the array structure expands. Conversely, when the temperature decreases, the structure contracts. In any case, the phase controls used for angularly aiming the radiated beam are no longer valid and lead to an aiming error which may be crippling.

A known solution for solving this problem is to carry out a calibration of the electronic scanning array. For this, the operating temperature range of the antenna is sampled, hence between the minimum operating temperature and the maximum operating temperature, and defects of illumination are recorded for amplitudes and phases of the various microwave-frequency channels of the array, a channel being associated with each module of the array. The defects measured during the calibration phase are stored in a table, a so-called calibration table. In the operational phase, the temperature-dependent defects are thus ascertained by reading off the calibration table. At a given temperature, the defect read off the table may thus be corrected by modifying the phase values in order to offset this defect.

A drawback of this solution is that it is tricky and lengthy to implement. Indeed, the measurements must be made for each temperature and copied into the calibration table. The number of measurements is important, as the range of operating temperatures must be sampled sufficiently and the measurements themselves must be made with care on account of the small misalignments involved. Although small, these misalignments may nonetheless impair the precision of detection of a radar.

SUMMARY OF THE INVENTION

An aim of the invention is to overcome the aforementioned drawbacks. To this end, a subject of the invention is a method for orienting the beam of an electronic scanning antenna, said antenna being composed of an array of radiating elements positioned in an initial geometric configuration at a reference temperature $T_0$, geometric configuration models of said array as a function of the temperature having been set up beforehand, the orientation of said beam is carried out by:

a first phase of measuring the temperature of said array in order to select a model corresponding to the measured temperature;

a second phase of calculating the phases, depending on the direction of aiming ($\theta$, $\varphi$), to be applied to the signals of the radiating elements for the selected model.

The geometric configuration models are, for example, calculated in a preliminary step with respect to said initial configuration depending on the temperature and on a thermal expansion coefficient TEC specific to said array.

A model indicates, for example, the geometric position of said radiating elements with respect to an axis system.

In the case in which the array is planar, the position of the radiating elements is, for example, defined by their coordinates (xi, yj) in an X, Y axis system, said phases depending on said coordinates.

In the case in which the array is linear, the position of the radiating elements is, for example, defined by their abscissae (xi) along an X axis, said phases depending on said abscissae.

In a possible implementation, said antenna operating in a given temperature range, the models are calculated for the temperatures sampled between the minimum value and the maximum value of the range according to a given increment.

Another subject of the invention is an electromagnetic sending and receiving system comprising an electronic scanning antenna composed of an array of radiating elements implementing the preceding method.

In particular, the system comprises, for example, means for storing said geometric configuration models as well as means for calculating said phases to be applied.

Advantageously, this system is notably capable of equipping a radar.

BRIEF DESCRIPTION OF THE DRAWINGS

Other features and advantages of the invention will become apparent with the aid of the description which follows, made in relation to the appended drawings which show.

DETAILED DESCRIPTION

Figure 1:
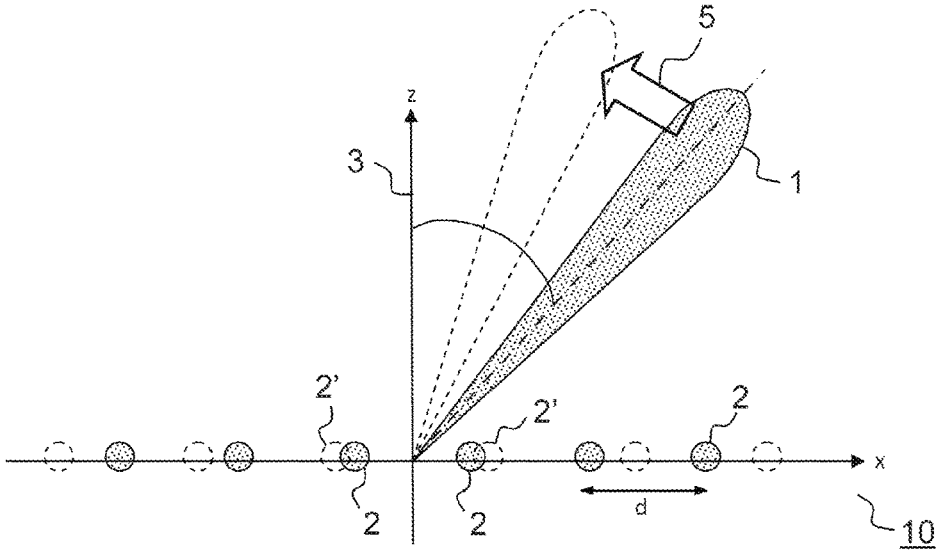
FIG. 1, an illustration of the misalignment of the beam of a linear array antenna.

FIG. 1 illustrates, in one dimension, the misalignment of a radiated beam 1 of an electronic scanning array antenna 10 due to a variation in ambient temperature. More specifically, FIG. 1 shows a linear array of radiating elements 2 positioned along an X axis.

In the example of FIG. 1, the variation in temperature is manifested as an increase in temperature. In the nominal state, the radiating elements 2, shown by dotted lines, are positioned regularly along the X axis. After the increase in temperature, the array of modules expands and the radiating elements are located in position 2', the distance between two modules growing.

In order to ensure that an array antenna operates correctly, the mesh of the array must be such that no grating periodicity lobe appears in the radiating space. As a general rule, this mesh is regular as illustrated in FIG. 1, in one dimension. It is defined by the spacing period between the radiating elements 2, defining the sampling of the radiating aperture by these radiating elements. In a first approach, this condition is obtained for a spacing between two radiating elements that is smaller than $\lambda_m$, $\lambda_m$ being the wavelength corresponding to the maximum operating frequency of the antenna 10. For an electronic scanning antenna the beam of which is misaligned up to an angle $\theta_M$, counted from the normal 3 to the array 10, this condition translates into a spacing smaller than $\lambda_m/(1+\cos\theta_M)$.

For an operating frequency $F=c/\lambda$, the phases to be applied to the radiating elements to angularly aim the radiated beam 1 in a direction θ are known. A radiating element of order i is positioned at an abscissa xi on the X axis. The phase Φi to be applied to the channel of order i, in degrees, is given by the following relationship:

$$\Phi i=360°\ xi\ \sin\theta/\lambda \quad (1)$$

by choosing, for example, the origin of the axis of the abscissae X at the center of the array.

For a regular array the radiating elements of which are spaced a distance d apart, the phase increment between two adjacent channels is therefore:

$$\Delta\Phi=360°\ d\ \sin\theta/\lambda \quad (2)$$

The invention will subsequently be described for a regular array, but it may be applied to any type of array.

Relationship (2) may thus be defined as a phase slope to be applied to the aperture of the array in order to misalign the beam. This slope p is defined by the following relationship:

$$p=360°\ \sin\theta/\lambda \quad (3)$$

p in fact defining a phase slope by unit length, ΔΦ being expressed as a function of the distance d by ΔΦ=p×d.

By inverting relationship (2), it is apparent that at a given frequency F, hence at a given wavelength λ, the angular direction of radiated aiming θ is given by the following relationship:

$$\theta=\arcsin\ [(\lambda,\Delta\Phi)/(360°,d)] \quad (4)$$

This relationship shows that, at a given frequency, if the gap d between radiating elements increases, then the angular aiming θ of the beam 1 decreases, hence the beam deviates 5 toward the normal 3 to the array as shown in FIG. 1.

Figure 2:
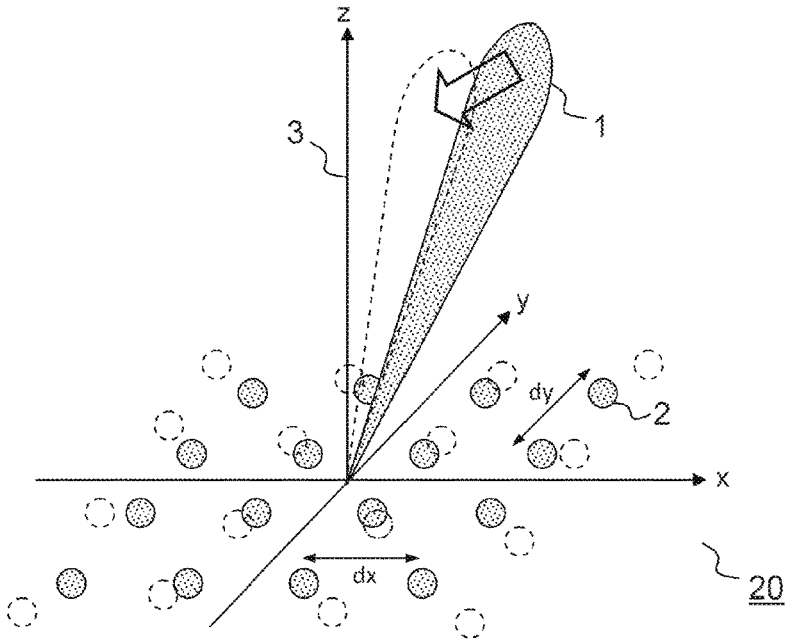
FIG. 2, an illustration of the misalignment of the beam of a planar array antenna.

FIG. 2 illustrates a beam misalignment in a case of application to a planar array antenna 20. The module array is shown in an X, Y axis system. The modules 2 are positioned, in this example, in a rectangular mesh.

Figure 3:
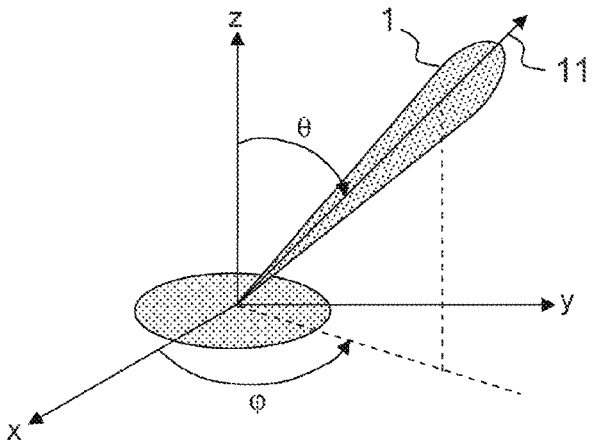
FIG. 3, an illustration of the spherical coordinates of the beam.

As in the preceding, one-dimensional, case, it is known how to calculate the phases to be applied to the channels in order to aim the beam 1 in a direction (θ, φ) at a frequency $F=c/\lambda$, θ and φ being the angles conventionally defined in a spherical coordinate system, as depicted in FIG. 3 showing the spherical coordinates (θ, φ) of the direction 11 of the beam.

A radiating element of order i along the X axis and of order j on the Y axis is positioned at the abscissa xi and at the ordinate yj, hence having the coordinates (xi, yj) in the plane X, Y, by selecting, for example, the center of the array as the origin of the axes.

The phase Φij to be applied to the channel (i, j), in degrees, is given by the following relationship:

$$\Phi ij=360°/\lambda\cdot[xi\ \sin\theta\ \cos\varphi+xj\ \sin\theta\ \sin\varphi] \quad (5)$$

For a regular array, a rectangular mesh for example, the radiating elements of which are spaced apart by a distance dx along the X axis and by a distance dy along the Y axis, the phase increment between adjacent channels is given by the following relationships:

$$\Delta\Phi1=360°\ dx\ \sin\theta\ \cos\varphi/\lambda \text{ along the X axis} \quad (6)$$

$$\Delta\Phi2=360°\ dy\ \sin\theta\ \cos\varphi/\lambda \text{ along the Y axis} \quad (7)$$

Similar expressions may be used for a non-rectangular regular mesh, in particular for a triangular mesh.

Analysis of relationships (6) and (7), in a manner analogous to the case of the linear array of FIG. 1, shows that at a given frequency, if the distance between radiating elements increases along one axis or along both axes, then the angular aiming of the beam decreases along one axis or along both axes, the beam deviating toward the normal 3 to the array 20.

An electronic scanning antenna comprises active channels executed in the form of modules mechanically mounted using a reference plane in order to guarantee correct mechanical alignment of the modules.

When the ambient temperature varies, the antenna deforms thermomechanically. If the temperature increases, expansion occurs. The radiating elements move away from one another. As shown previously, for a control of the phase law effecting a given angular aiming of the beam at a given frequency, mechanical expansion of the array leads to a change in the aiming angle of the beam that in this case moves toward the axis 3 of the antenna. The effect is inverted in the case of a decrease in temperature, the radiating elements moving toward one another.

Aiming precision is of course an essential characteristic for a radar. Specifically, levels of precision of the order of, for example, a milliradian (about 0.06°) are desired for a radar operating in the X band.

The temperature-dependent behavior of a material is characterized by a thermal expansion coefficient, denoted by TEC hereinafter. For example, for a material such as light alloy 5086, this TEC coefficient is of the order of $24\cdot10^{-6}$ per degree Kelvin (K) and per unit length. Stated otherwise, if $L_0$ is a reference dimension at the ambient temperature $T_0$ corresponding to the nominal dimensions of the mesh, then the length distortion at a temperature T is expressed by the following relationship:

$$\Delta L=CTE\cdot\Delta T\cdot L_0 \quad (8)$$

$\Delta T=T-T_0$ being the temperature gradient and $\Delta L$ the variation in reference length.

For example, to misalign a beam oriented at $\theta_0=60°$ at 10 GHz, a phase slope $p_0=360° \sin 60°/\lambda$ must be applied, where $\lambda=30$ mm, the slope being in °/mm (degrees per millimeter).

A temperature difference of $\Delta T$ leads to mechanical expansion, hence a change in the phase slope p that becomes:

$$p=360° \sin 60°/\lambda \cdot L_0/(L_0-\Delta L) \quad (9)$$

For a small variation, this slope may be given by an approximate value, namely:

$$p=360° \sin 60°/[\lambda \cdot (1+\Delta L/L_0)] \quad (10)$$

Thereby leading to a change in the angular aiming of the beam 1, this aiming being given by its angle $\theta$, in degrees:

$$\theta=\arcsin [\lambda \cdot p_0/(360 \cdot (1+\Delta L/L_0)) \quad (11)$$

For a temperature variation $\Delta T=25°$ on a material for which the expansion coefficient $TEC=24 \cdot 10^{-6}/K$ per unit length, $$\Delta L/L_0=CTE \cdot \Delta T=6 \cdot 10^{-4} \quad (12)$$

Taking $p_0=360° \sin 60°/\lambda$ from the preceding example, according to relationships (11) and (12), the aiming angle of the beam then becomes:

$$\theta=\arcsin [\sin 60°/(360 \cdot (1+6 \cdot 10^{-4}))=59.94°$$

It follows that the variation in angular aiming is of the same order as the desired angular precision.

Figure 4:
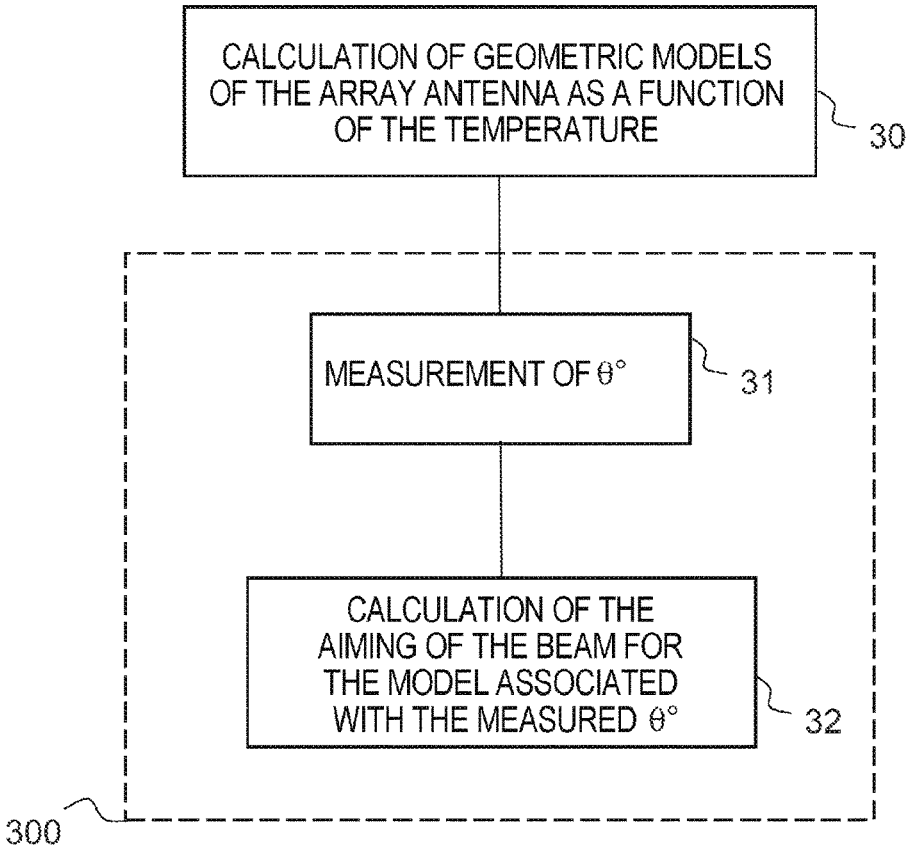
FIG. 4, possible steps for the implementation of the method according to the invention.

FIG. 4 illustrates possible steps of the method according to the invention. The invention advantageously makes use of the knowledge of how thermal expansion changes the geometry of an electronic scanning array antenna 10, 20 in order to correct the angular aiming controls of the radiated beam 1. Again advantageously, the contribution of the error linked to the temperature-dependent expansion of the antenna may be taken into account by modeling in order to compensate, using a simple calculation, for the defect in angular aiming of the beam resulting therefrom. It is indeed possible to calculate a model of the array as a function of the temperature, phase shift values per radiating element being associated with each temperature. The operating temperature range is sampled in such a way that a model is calculated per temperature increment. For example, a temperature increment equal to 1 degree Celsius may be taken.

Thus, according to the invention, by knowing the mechanical expansion, or contraction, coefficient of the antenna as a function of the temperature, it is possible to set up new phase controls that take into account the deformation of the antenna array in order to aim the radiated beam in the correct angular direction.

In a preliminary step 30, an associated geometric model is calculated for each temperature. More specifically, the position of the radiating elements is calculated. The positions are calculated with respect to nominal positions corresponding to the reference temperature $T_0$, 20° C. for example. In particular, for each radiating element 2, it is known how to calculate, based on the thermal expansion coefficient TEC, its position with respect to its nominal position, as a function of the temperature. The geometry of the antenna is modeled over its range of operating temperatures, for temperature values sampled between the minimum temperature and the maximum temperature.

To angularly aim the beam in a given direction ($\theta$, $\varphi$) at a temperature T differing from the reference temperature $T_0$ by a value $\Delta T$, it is necessary to apply, to the array of radiating elements (i, j) positioned according to coordinates (xi, yj), a phase:

$$\Phi ij=360°/\lambda \cdot [xi \sin \theta \cos \varphi+yj \sin \theta \sin \varphi]$$

in accordance with relationship (5)

where the coordinates (xi, yj) differ from the initial geometry coordinates ($x_0i$, $y_0j$) corresponding to the reference temperature $T_0$. The difference is a relative value TEC $\Delta T$.

The TEC coefficient is considered to be the same for all of the radiating elements and to be specific to the array.

Returning to FIG. 4. While operating 300, before the phase 32 of calculating the aiming of the radiated beam, a phase 31 of measuring the temperature is carried out. The measured temperature indicates the geometric antenna model to be taken into account for calculating the beam. In particular, this model specifies the coordinates (xi, yj) of the radiating elements to be taken into account for calculating the beam by applying the phases $\Phi ij$ to the radiating elements according to relationship (5).

Thus in the first phase 31, the temperature at the array 20 is measured, then the model corresponding to this temperature is selected.

As the models are calculated for the temperatures sampled according to a given increment, a model corresponds to a measured temperature if that measured temperature lies in the sampling increment for which the model is calculated.

In the second phase 32, the phases are calculated that are to be applied to the signals of the radiating elements for the model selected depending on the desired aiming direction ($\theta$, $\varphi$).

In the case of application to a linear antenna, in one dimension, phases defined according to relationship (1) as a function of the abscissa xi will be applied.

Step 30 of geometrically modeling the antenna array as a function of the temperature may be carried out just once or periodically according to mechanical developments of the antenna.

The modeling may advantageously take into account, in addition to the mechanical support, all of the elements constitutive of the array antenna the behaviour of which varies with temperature, these elements potentially being, in particular, active elements or transmission lines.

The invention is advantageously applicable to all systems for sending and receiving electromagnetic waves equipped with an electronic scanning antenna, such as radar systems or telecommunications systems, for example. Besides the sending and receiving components known elsewhere, such a sending and receiving system comprises the means for calculating and controlling the phases of the radiating elements. It also comprises, for example in memory, the models associated with the various temperatures. At least, a model is stored by storing the coordinates (xi, yj) of the radiating elements in an axis system.

The invention claimed is:

1. A method for orienting a beam of an electronic scanning antenna, said antenna being comprised of an array of radiating elements positioned in an initial geometric configuration at a reference temperature, wherein, geometric configuration models of said array as a function of temperature having been set up beforehand, the method comprising:

measuring a temperature of said array in order to select a model from the geometric configuration models that corresponds to the measured temperature; and calculating phases, depending on a direction of aiming, to be applied to signals of the radiating elements for the selected model.

2. The method as claimed in claim 1, wherein the geometric configuration models are calculated with respect to said initial configuration depending on temperature and on a thermal expansion coefficient TEC specific to radiating elements of said array.

3. The method as claimed in claim 1, wherein a model indicates the geometric position of said radiating elements with respect to an axis system.

4. The method as claimed in claim 3, wherein said array being planar, the position of the radiating elements is defined by their coordinates in an X, Y axis system, said phases depending on said coordinates.

5. The method as claimed in claim 3, wherein said array being linear, the position of the radiating elements is defined by their abscissae along an X axis, said phases depending on said abscissae.

6. The method as claimed in claim 1, wherein said antenna operating in a given temperature range, the models are calculated for the temperatures sampled between the minimum value and the maximum value of the range according to a given increment.

7. A system for sending and receiving electromagnetic waves, comprising an electronic scanning antenna comprised of an array of radiating elements, wherein the system implementing the method as claimed in claim 1.

8. The sending and receiving system as claimed in claim 7, comprising means for storing said geometric configuration models.

9. The sending and receiving system as claimed in claim 7, comprising means for calculating said phases to be applied.

10. The sending and receiving system as claimed in claim 7, wherein the system is capable of equipping a radar.

* * * * *